US009096369B2

(12) United States Patent
Bertin

(10) Patent No.: US 9,096,369 B2
(45) Date of Patent: Aug. 4, 2015

(54) PORTABLE FOOD OR BEVERAGE AND CONDIMENT KIT

(76) Inventor: Bruno Bertin, Auburn, PA (US)

( * ) Notice: Subject to any disclaimer, the term of this patent is extended or adjusted under 35 U.S.C. 154(b) by 764 days.

(21) Appl. No.: 12/458,194

(22) Filed: Jul. 2, 2009

(65) Prior Publication Data

US 2011/0000908 A1 Jan. 6, 2011

(51) Int. Cl.
*B65D 81/32* (2006.01)

(52) U.S. Cl.
CPC ..... *B65D 81/32* (2013.01)

(58) Field of Classification Search
CPC ..... B65D 2215/04; B65D 2575/3227; B65D 5/5007; B65D 5/5009; B65D 51/2832; B65D 75/327; B65D 77/04; B65D 81/3211; B65D 81/3222
USPC ..... 206/222, 277; 222/254.1–254.4, 254.6, 222/548, 567; 215/DIG. 8; 426/115, 122; 141/18
See application file for complete search history.

(56) References Cited

U.S. PATENT DOCUMENTS

| | | | | | |
|---|---|---|---|---|---|
| 3,326,363 | A * | 6/1967 | Bennett et al. | 206/219 |
| 4,614,437 | A * | 9/1986 | Buehler | 366/130 |
| 5,076,425 | A | 12/1991 | Plone | |
| 5,209,565 | A * | 5/1993 | Goncalves | 366/130 |
| 5,366,114 | A * | 11/1994 | Bernstein et al. | 222/83 |
| 5,370,222 | A * | 12/1994 | Steigerwald et al. | 206/222 |
| 5,718,933 | A * | 2/1998 | Fultz | 426/115 |
| 5,871,116 | A * | 2/1999 | Picchietti | 220/501 |
| 6,021,903 | A * | 2/2000 | Hanson | 206/541 |
| 6,302,268 | B1 | 10/2001 | Michaeli | |
| 6,386,443 | B1 | 5/2002 | Szczerbinski | |
| 6,533,113 | B2 * | 3/2003 | Moscovitz | 206/222 |
| 6,708,735 | B1 * | 3/2004 | Kenihan | 141/18 |
| 6,986,472 | B2 | 1/2006 | Gordon | |
| 6,994,211 | B2 * | 2/2006 | Cho | 206/221 |
| 7,614,496 | B2 * | 11/2009 | Dvorak et al. | 206/219 |
| 7,690,534 | B2 * | 4/2010 | Revenu | 222/129 |
| 2004/0200845 | A1 * | 10/2004 | Watzke et al. | 220/501 |
| 2007/0023299 | A1 * | 2/2007 | Clarkson | 206/219 |
| 2007/0039975 | A1 * | 2/2007 | Bochtler | 222/142.5 |
| 2008/0105681 | A1 * | 5/2008 | Vovan | 220/288 |
| 2009/0008274 | A1 | 1/2009 | Bertin | |

OTHER PUBLICATIONS

Photograph 1 of salad container manufactured by Bonduelle Food Service of France, www.bonduelle.com.
Fit and Fresh Salad Shaker product Sep. 21, 2007, www.fit-fresh.com/salad.html.

* cited by examiner

*Primary Examiner* — Anthony Stashick
*Assistant Examiner* — Kaushikkumar Desai
(74) *Attorney, Agent, or Firm* — Roylance, Abrams, Berdo & Goodman, L.L.P.

(57) ABSTRACT

A food and condiment kit comprising a container with a top, a bottom, and an interior. A tray coupled to the top of the container includes at least one opening to receive a cup with a first end facing the bottom of the container. A ring with an interior edge and a plurality of clasps disposed around the interior edge is coupled to the first end of the cup. A cutting mechanism coupled to the ring protrudes towards the first end of the cup. A lining covers the open end of the cup sealing the contents of the cup from the contents of the container until the cup is rotated around the cutting mechanism to cut the lining and thereby release the contents therein.

9 Claims, 9 Drawing Sheets

PORTABLE FOOD OR BEVERAGE AND CONDIMENT KIT

FIELD OF THE INVENTION

The present invention relates to a portable food and condiment kit. More particularly, the invention relates to a disposable container having a removable tray containing additional food items or condiments that are easily dispensed and distributed to the rest of the container storing the main food item, such as salad, cereal, coffee, or related food or beverage item.

BACKGROUND OF THE INVENTION

Conventional food or beverage and condiment kits for on-the-go use include a container filled with food such as salad and a separate packet containing a condiment such as salad dressing. A user opens the salad dressing packets to dispense salad dressing throughout the container. Although convenient, these packets are cumbersome because they typically distribute the salad dressing over the top layers of the salad, often resulting in an uneven distribution of salad dressing throughout the container. Oftentimes, when a user reaches the bottom of the container after consuming most of the salad, there is not enough salad dressing for the bottom layers because the majority of the salad dressing has already coated the upper layers.

U.S. Pat. No. 6,386,443 to Szczerbinski discloses a combination food and condiment dispenser which provides a compartment for ketchup, or a similar topping, clipped to the top of a French fry container.

U.S. Pat. No. 6,302,268 to Michaeli discloses a salad container having an insert chamber for salad dressing. The salad dressing is injected into the container at the top of the salad. This does not provide even distribution of the salad dressing through the salad because the dressing is concentrated towards the upper portion of the container.

U.S. Pat. No. 5,076,425 to Plone discloses a dispensing stick for dispensing a substance into a container. The stick is combined with a dispensing lid for convenience.

U.S. Patent Application No. 2009/0008274 discloses a food container having a chamber for separating a condiment packet from the food and dispensing the contents of the packet by engaging a spring activated chamber that controls the alignment of the packet with the container. The chamber includes a plurality of openings that align with openings in the packet to controllably release the contents of the packet through the openings in the chamber wall.

Although the above inventions are useful for convenience and combining condiments with food items, a need exists for evenly distributing condiments, toppings, or additives throughout a container having a food or beverage. There is also a need for an economical and efficient apparatus of doing the same.

SUMMARY OF THE INVENTION

Accordingly, an object of the present invention is to provide a food or beverage container with a tray for storing optional condiments or additives, such as salad dressing, sauce, and various toppings.

Another object of the invention is to provide a sterile, single use dispensing mechanism for adding condiments to a food container.

A further object of the invention is to provide a cutting mechanism attached to the dispensing mechanism for perforating the sterile lining separating the condiment from the main food or beverage item.

Still another object of the invention is to provide a removable tray containing the toppings and cutting mechanism that can be disposed of after adding the toppings to the container.

Yet another object of the invention is to provide a tray with a plurality of compartments for distributing wet and dry ingredients into a food item contained in the interior section of the container.

The foregoing objects are basically attained by providing a food or beverage container and condiment kit comprising a container having a top, a bottom, and an interior. A tray is suspended above the interior of the container and includes at least one opening for receiving a cup with condiments for the food or beverage. The cup has an aperture at a first end adjacent the tray, covered with a lining to separate the condiment from the food container. A ring having an interior edge and a plurality of clasps disposed around the edge is engaged to the first end of the cup. A cutting mechanism coupled to the ring protruding towards the cup perforates the lining.

The foregoing objects are also attained by gripping an end of at least one cup engaged to a tray and rotating the cup through a ring attached to an opening in the tray. A lining covering an end of the cup adjacent the tray opening is perforated, causing the contents from the cup to be ejected into the bottom of the container.

By forming the condiment kit in this manner, a user is able to distribute fresh toppings from a tray suspended above the interior of the container into the substantive food or beverage item. Moreover, prior to distribution, the condiments are sealed off from the rest of the container until the lining is perforated and contents from the cup are dispensed into the food or beverage of the container.

As used in this application, the terms "top", "bottom", and "side" are intended to facilitate the description of the food or beverage and condiment kit and container, and are not intended to limit the food or beverage and condiment kit and container of the present invention to any particular orientation.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure.

Throughout the drawings, like reference numerals will be understood to refer to like parts, components, and structures.

DETAILED DESCRIPTION OF THE INVENTION

Figure 1:
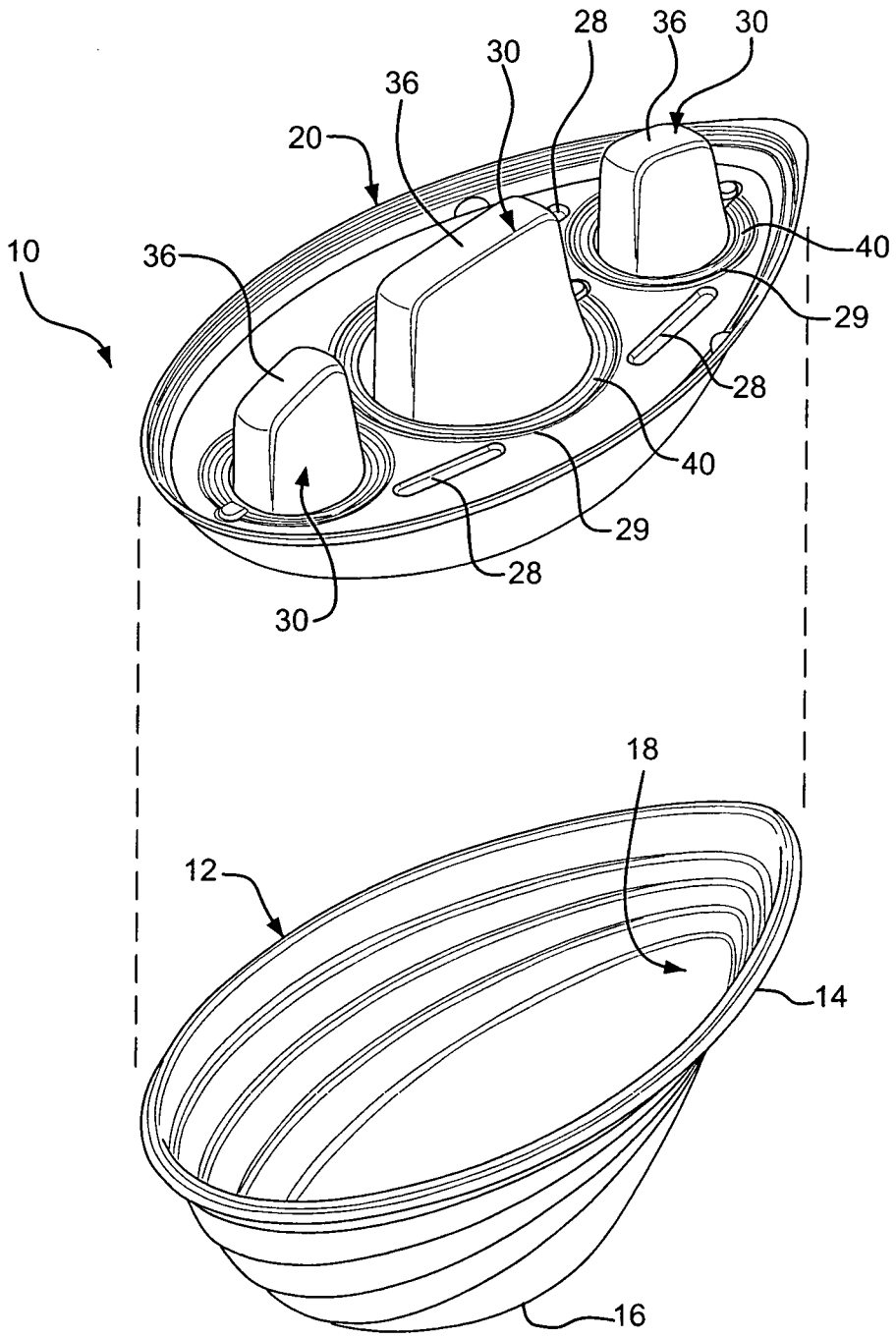
FIG. 1 is a top perspective view of the food container according to the first embodiment of the invention.
Figure 2:
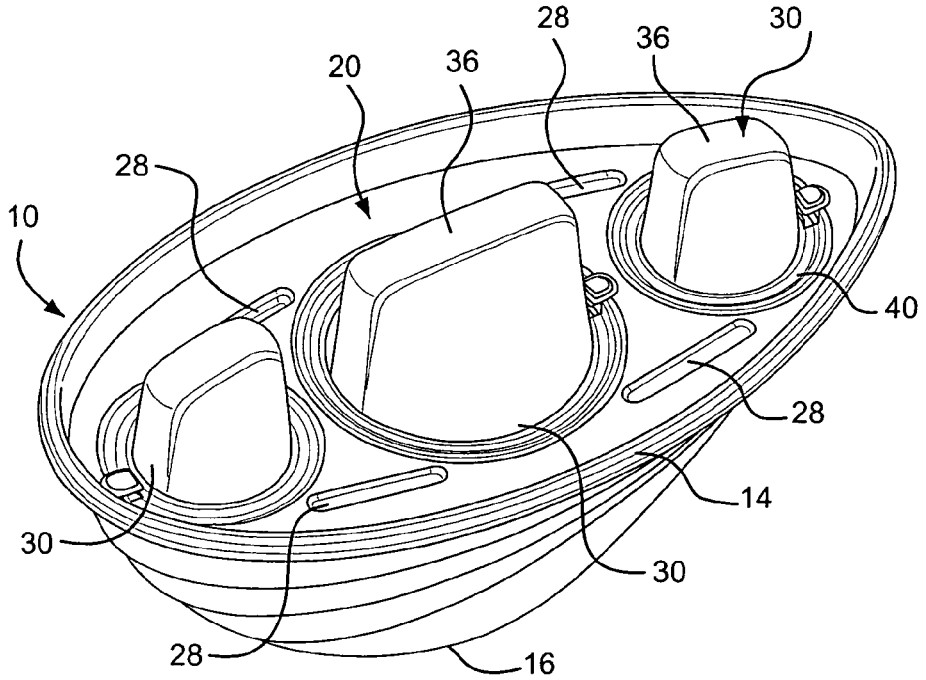
FIG. 2 is a top perspective view of the food container according to FIG. 1 with the tray snapped into the container.
Figure 3:
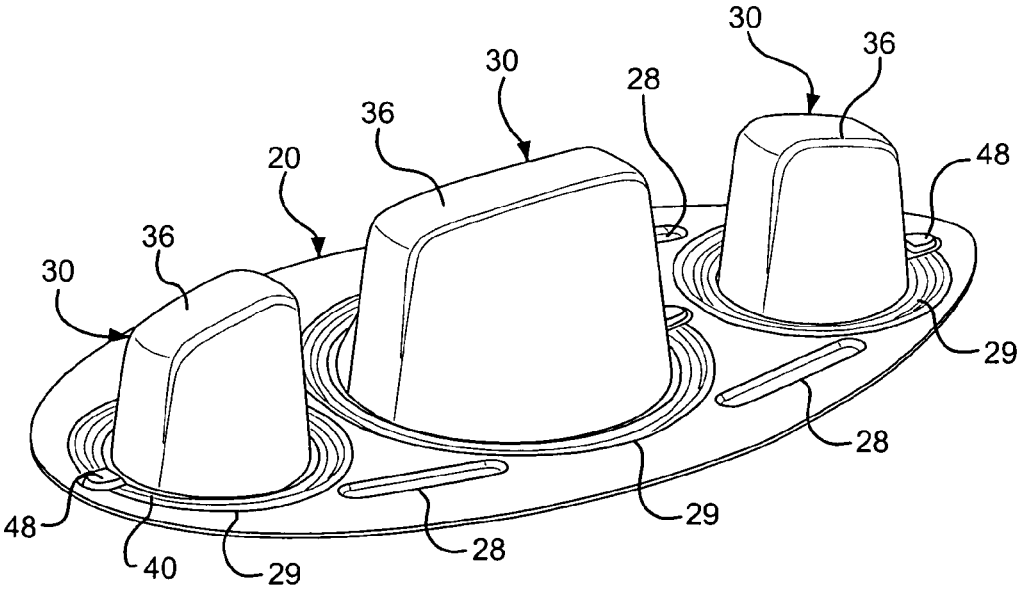
FIG. 3 is a side perspective view of the tray assembly according to FIGS. 1 and 2.

Turning to FIGS. 1-6, a food or beverage container kit 10 includes a container 12, a tray 20 suspended above the container 12 with at least one opening 22, a cup 30 containing at least one condiment for the food or beverage and received in each opening 22, a ring 40 engaged to each cup 30, and a cutting mechanism 46 coupled to the ring 40 for perforating a lining 50 separating the contents of the cup 30 from the interior 18 of the container 12.

Figure 8:
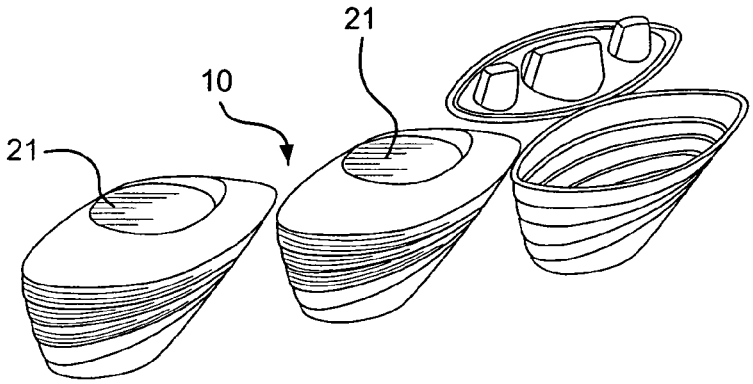
FIG. 8 is a top perspective view of a food container according to the second embodiment of the invention.
Figure 9:
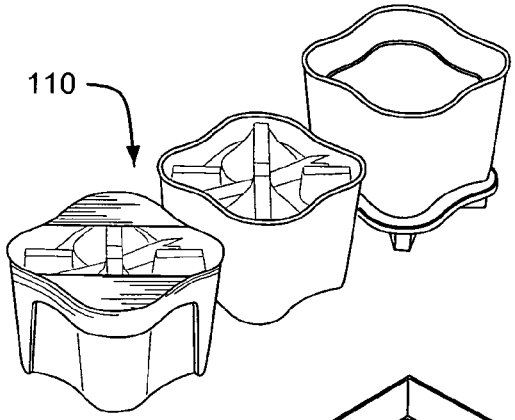
FIG. 9 is a top perspective view of a food container according to the third embodiment of the invention.
Figure 10:
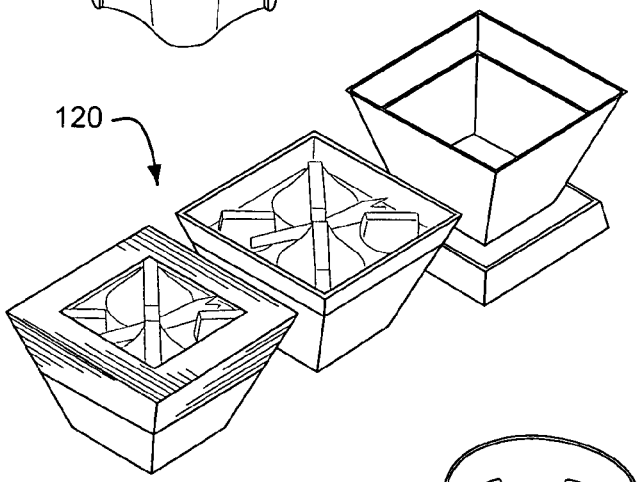
FIG. 10 is a top perspective view of a food container according to the fourth embodiment of the invention.
Figure 11:
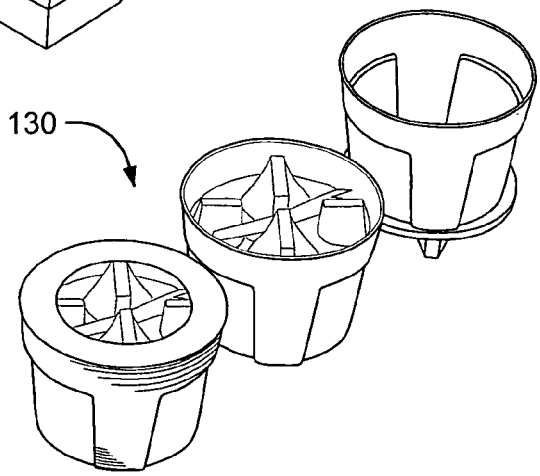
FIG. 11 is a top perspective view of a food container according to the fifth embodiment of the invention.

The container 12 can take on a variety of shapes, as illustrated in FIGS. 8-11. The container shape can include a circular device 130 (FIG. 11), a rectangular device 120 (FIG. 10), a rectangular device 110 with concave centers along each side (FIG. 9), and an oval device 10 with contoured ends (FIG. 8). The type of food or beverage contained therein will dictate the shape of the container selected (i.e., beverage suitable for a circularly-shaped container). For purposes of discussion, the oval container will be described as the main embodiment, but the description and details are applicable to each of the container shapes, illustrated in FIGS. 8-11. As shown in FIGS. 1-8, the container 12 of the present embodiment is substantially oval-shaped with contoured ends and a bottom 16 that is substantially narrower than the top 14.

The container 12 can be filled with a variety of food items in its interior 18 such as salad, pasta, cereal, or the like. A tray 20 suspended above the interior 18 separates the condiments, such as salad dressing, pasta sauce, sugar, or the like, from the main food item stored in the interior 18, until the user is ready to consume the main food or beverage item and dispenses the condiments from the top 14 of the container 12 into the interior 18. The shape of the removable tray 20 is equivalent to the shape of the container 12 allowing the bottom surface of the tray 20 to extend along the entire rim of the container 12 until the contents of the cups 30 are dispensed and the tray 20 is removed from the container 12 by the consumer.

Prior to consumer use, the tray 20 is covered by a cover 21, seen in FIG. 8. The cover 21 is removed to reveal the tray 20 and its cups 30. After the contents of the cups 30 are dispensed and the tray 20 is removed, it can be coupled to the cover 21 and placed beneath the container 12 such that the bottom surface of the tray rests on a surface or table and the top surface of the cover 21 is coupled to the bottom surface of the main container. This fitting also prevents seepage of any remaining items from the cup 30.

The tray 20 in the main embodiment, for purposes of explanation, is substantially oval with at least one circular opening 22. The tray 20 includes a plurality of longitudinal ribs 28 aligned laterally along the outer surfaces thereof to stabilize the tray 20 against deformation or from seeping into the interior 18 of the container 12. As seen in FIG. 1, the ribs 28 are also disposed between the plurality of cups 30. The tray 20 further comprises depressions 29 around each aperture 32 for receiving the cup rings 40. The depressions 29 are shaped to include the ring 40 and guide 48. The depressions include a plurality of receiving inlets 45 to secure the ring 40 to the tray 20. The inlets 45 are recessed from the main circumference of depressions 29.

Figure 4:
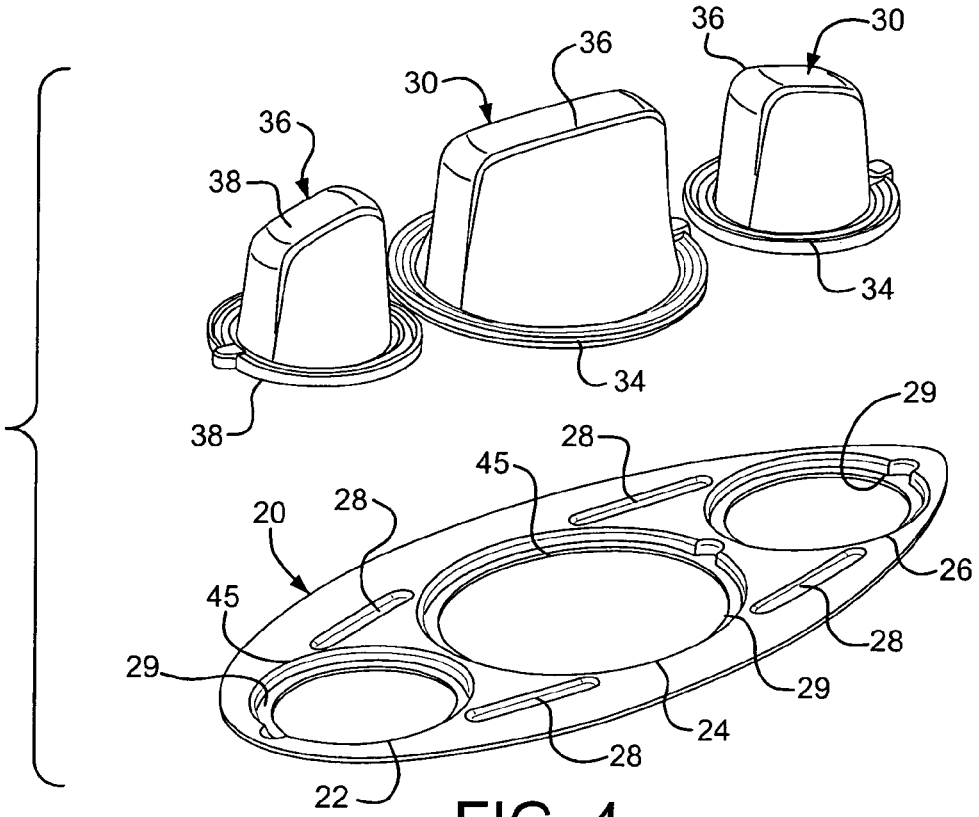
FIG. 4 is a side perspective exploded view of the tray assembly according to FIGS. 1-3.
Figure 5:
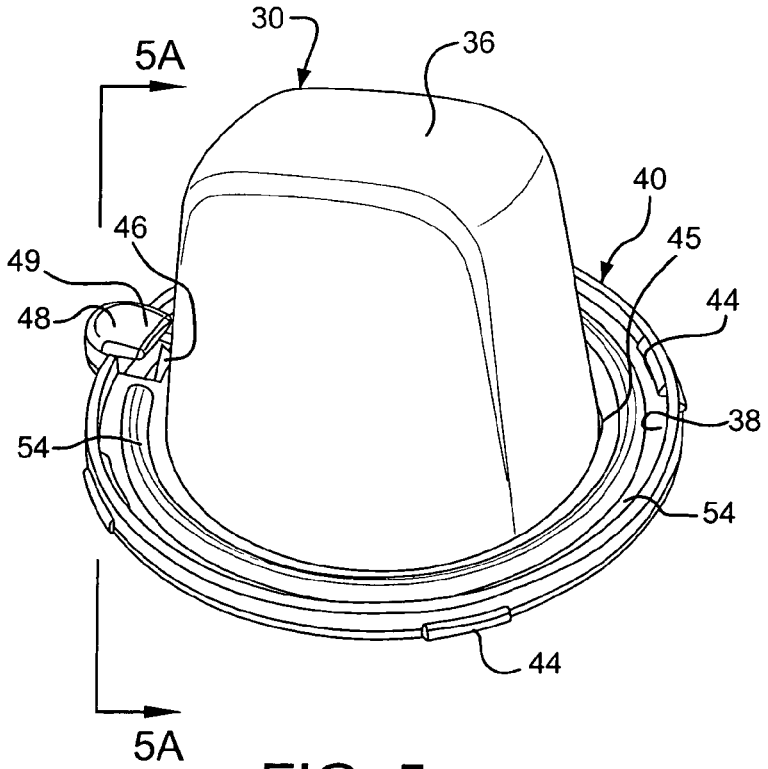
FIG. 5 is a side perspective view of one of the cups according to FIGS. 1-4.

As seen in FIG. 4, the tray 20 includes a plurality of openings 22, 24, 26 for receiving a plurality of cups 30 therein. The openings 22, 24, 26 can include a plurality of sizes to receive different cup sizes. Each cup 30 contains a different condiment. In some instances, due to the size of the cups 30 versus the amount of food in the container 12, more than one cup 30 may include the same condiment.

Figure 6:
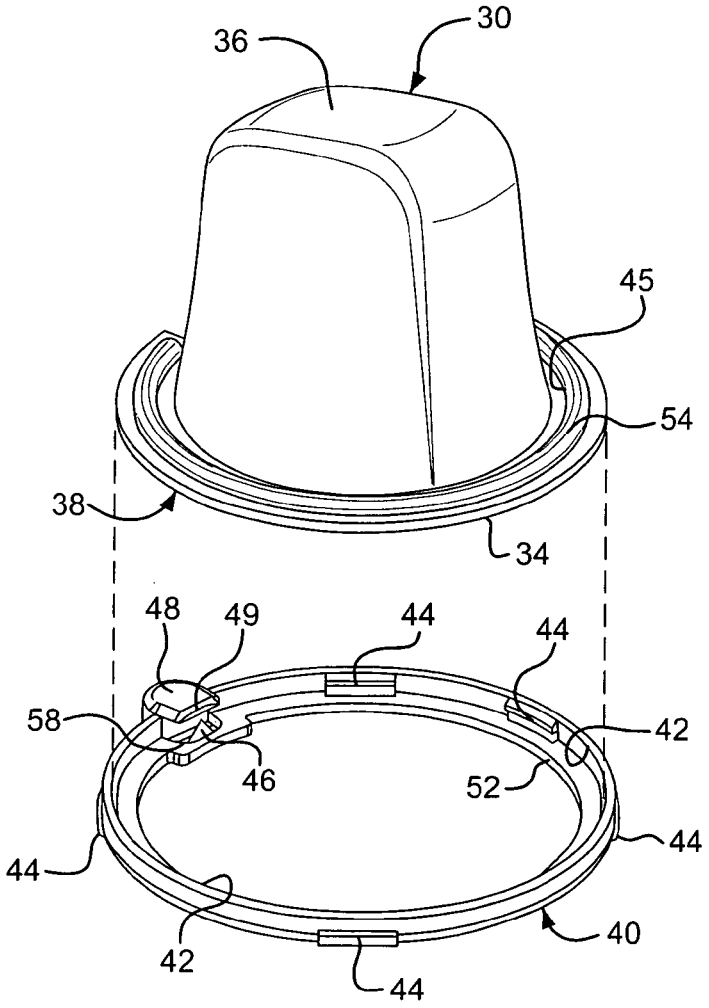
FIG. 6 is a side perspective exploded view of one of the cups according to FIGS. 1-5.

Turning to FIG. 6, the cup 30 includes a first open end 34 facing towards the bottom 16 of the container 12 and a second end 36 facing away from the container 12. The shape of the cup 30 is contoured to function as a knob or handle and fit between a user's fingers. Preferably, the second end 36 is narrower than the first end 34, but the thickness of the second end 36 is enough for a user to grasp and rotate. The first end 34 is covered by a seal or lining 50 adapted to be perforated by the cutting mechanism 46. The lining 50 is a protective layer disposed across the open end 34 and rim 38 to separate the contents of the cup 30 and the interior 18 of the container 12 until the user is ready to consume the food or beverage and add the various condiments of each cup 30 to the item in the container 12. When the user needs to access the contents of the cup 30, the lining 50 is removed by the cutting mechanism 46 to dispense the contents into the interior 18 section.

The outermost portion of the cup 30 is the rim 38 that extends around a substantial portion of the circumference of the outer edge of the cup 30. Further, the rim 38 includes a raised rib 54 extending towards the second end 36 of the cup 30 and forms an open annular channel 51 in the bottom face of rim 38. Thus, the lining 50 also covers the channel until it is cut by the cutting mechanism 46. The cup 30 is attached to the tray 20 by fitting into the ring 40 extending around the rim 38 of the cup 30. In one embodiment, the liner 50 is attached to the outer portion of the rim 38 so that cutting the liner 50 in the area of the open channel 51 allows a portion of the liner to be removed thereby allowing the contents of the cup to fall into container 12.

The ring 40 is made of a durable plastic or similar material that is disposable and inexpensive to manufacture. The ring 40 is circular with an interior edge 42 extending vertically and a lip 52 extending inwardly towards the center of the ring 40 and the cup 30 and oriented substantially perpendicular to the interior edge 42 (therefore, the lip 52 is substantially planar, as shown, e.g., in FIGS. 5A and 6). The ring 40 includes a plurality of clasps 44 disposed around the interior edge 42 thereof. The inner portion of the clasps 44 within the circumference of the ring 40 secures the rim 38 of cup 30 to the ring 40 in a snap-fit connection. The outer portion of the clasps 44 disposed on the outer circumference of the ring 40 fits into the inlets 45 along the depressions 29 of the tray 20 to provide a snap-fit connection between the ring 40 and the tray 20. This connection prevents the ring 40 from being ejected from the tray 20 when the cup 30 is rotated. Additionally, as shown, e.g., in FIG. 4, the rim 38 includes a tab that fits in a corresponding recess in the tray 20, to prevent rotation of the ring 40 relative to the tray 20.

Figure 5A:
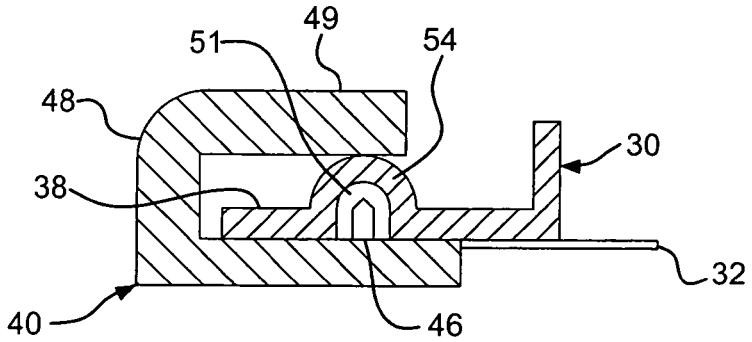
FIG. 5A is a sectional view of the ring as seen in FIG. 5 along the line 5A-5A.
Figure 7:
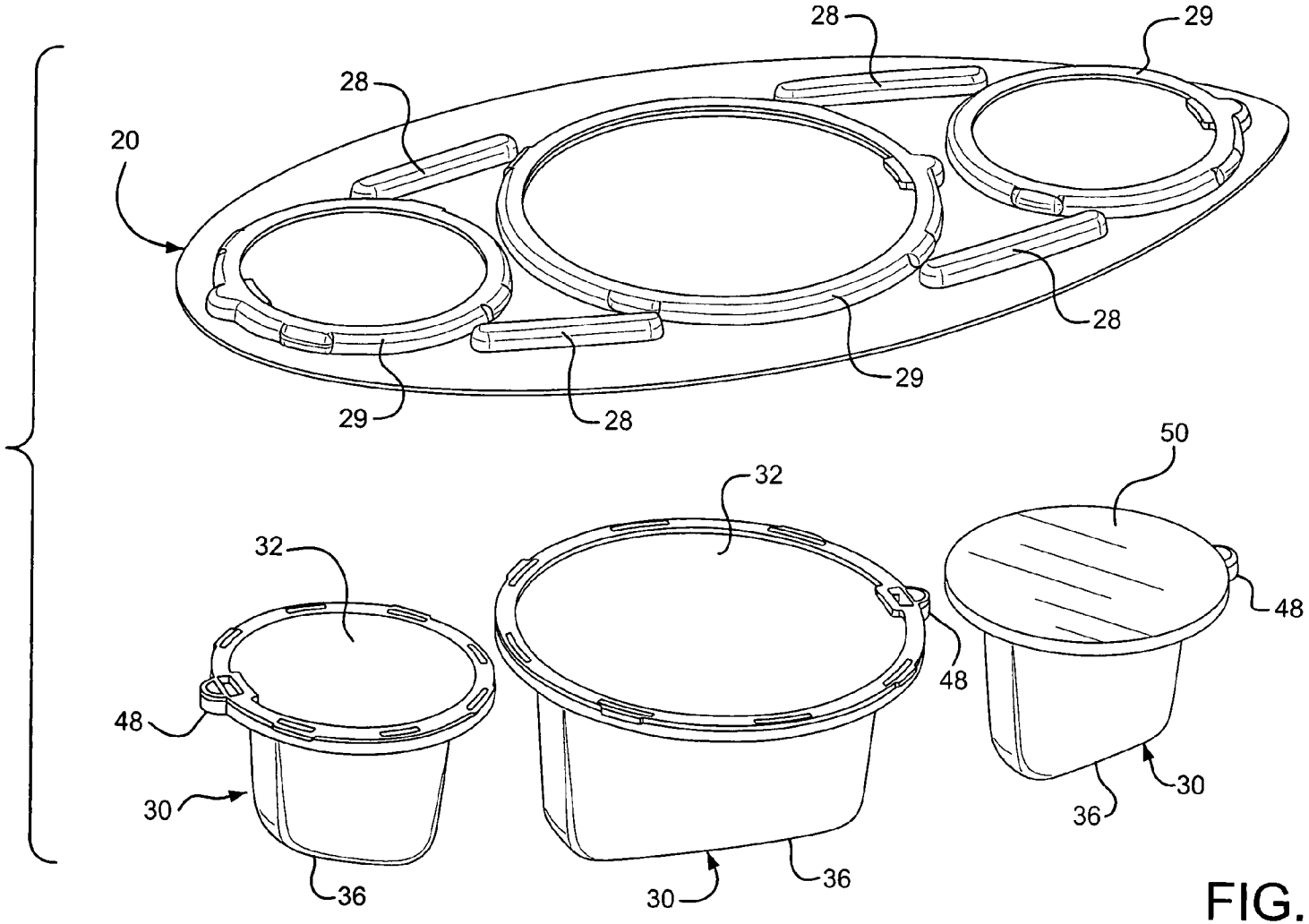
FIG. 7 is a bottom perspective view of the tray assembly according to FIGS. 1-6 with the cups removed from the tray and the tops of the cups exposed.

The ring 40 also includes a guide 48 aligned with the cutting mechanism 46. The guide 48 further includes a portion 49 that extends over the interior edge 42 and extends substantially parallel to the lip 52. The cutting mechanism 46 is coupled to the lip 52 of ring 40 and is oriented upwardly towards the portion 49 of guide 48 and toward the lining 50 of the cup 30 when the cup 30 is coupled to the ring 40. As seen in FIG. 5A, the cutting mechanism 46 protrudes into the channel 51 formed by rib 54 to perforate the lining 50 extending across the open end 32. The channel 51 is formed by the rib 54 disposed above the rim 38 and the cutting mechanism 46 slices through lining 50 in the area overlying the channel 51.

When the cup 30 and the ring 40 are coupled to the tray 20, the rim 38 of cup 30 fits between the lip 52 of ring 40 and the guide 48 which covers the edge of the rim 38. When the ring 40 is properly installed, the cup 30 is rotatable approximately 360° . As the cup 30 rotates with respect to ring 40 (without advancing the cup 30 in a direction substantially perpendicular to the lip 52 because the lip 52 is substantially planar and extends substantially perpendicular to the interior edge 42), the lining 50 covering the open end 32 is cut by the cutting mechanism 46. It is possible to determine where the cutting mechanism 46 is cutting the lining 50 at a particular position by the location the guide 48. The guide 48 is located directly over the sharp edge 58 of the cutting mechanism 46. The cups can be made sufficiently flexible so that the walls of the cups can be squeezed inwardly by the user to dispense the contents through the cut portion of the lining 50.

The container 12 includes a sterilization feature such as a protective seal covering the sides of the container 12 where the tray 20 is inserted into the rest of the container 12. A seal overlaps the entire edge of the junction between the tray 20 and container 12 to prevent tampering by anyone other than the consumer.

Figure 12:
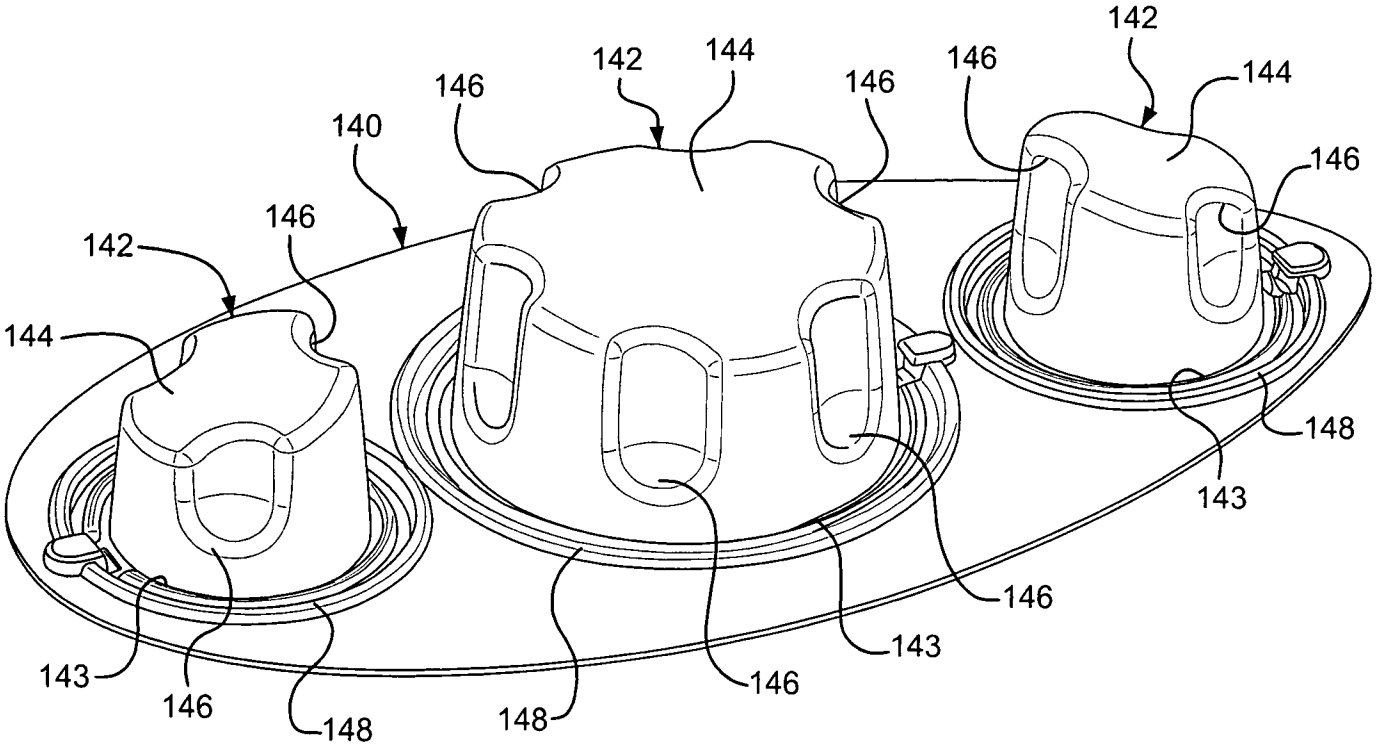
FIG. 12 is a side perspective view of a tray assembly according to the sixth embodiment of the invention.

In an alternative embodiment, illustrated in FIG. 12, tray 140 includes a plurality of cups 142 having a different shape than that of the cups 30 disclosed in the embodiment illustrated in FIGS. 1-7. However, the cups 142 are embedded into the tray 140 with the same ring connection as the previous embodiment and thus the cutting mechanism for removing the lining is the same. The cups 142 have a first end 143 coupled to the tray 140 and a second end 144 opposite the tray 140 with a plurality of dimples 146 disposed around the circumference. The dimples 146 allow a user to grip the end 144 of the cup 142.

Figure 13:
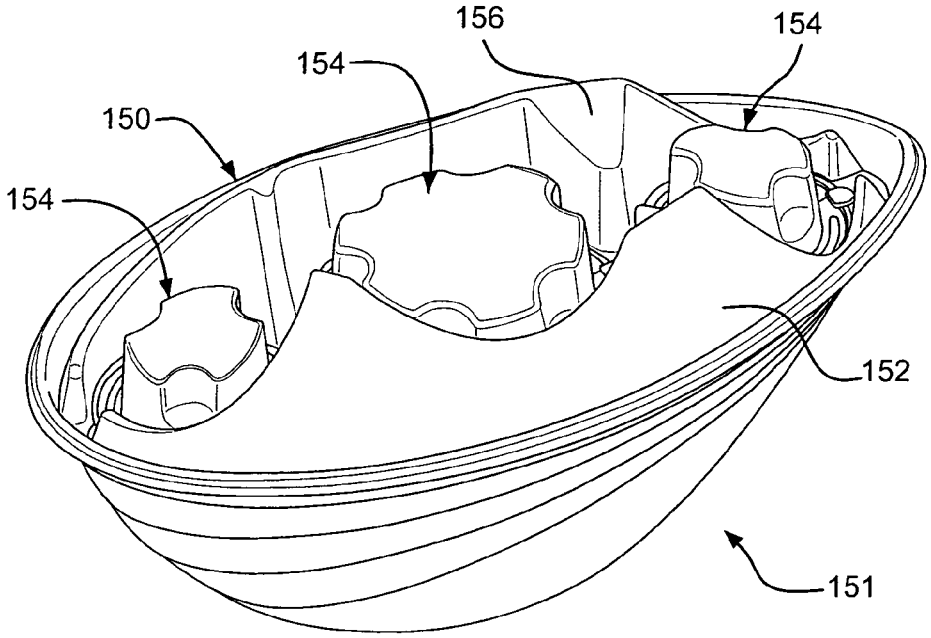
FIG. 13 is a top perspective view of a food container according to the seventh embodiment of the invention.
Figure 14:
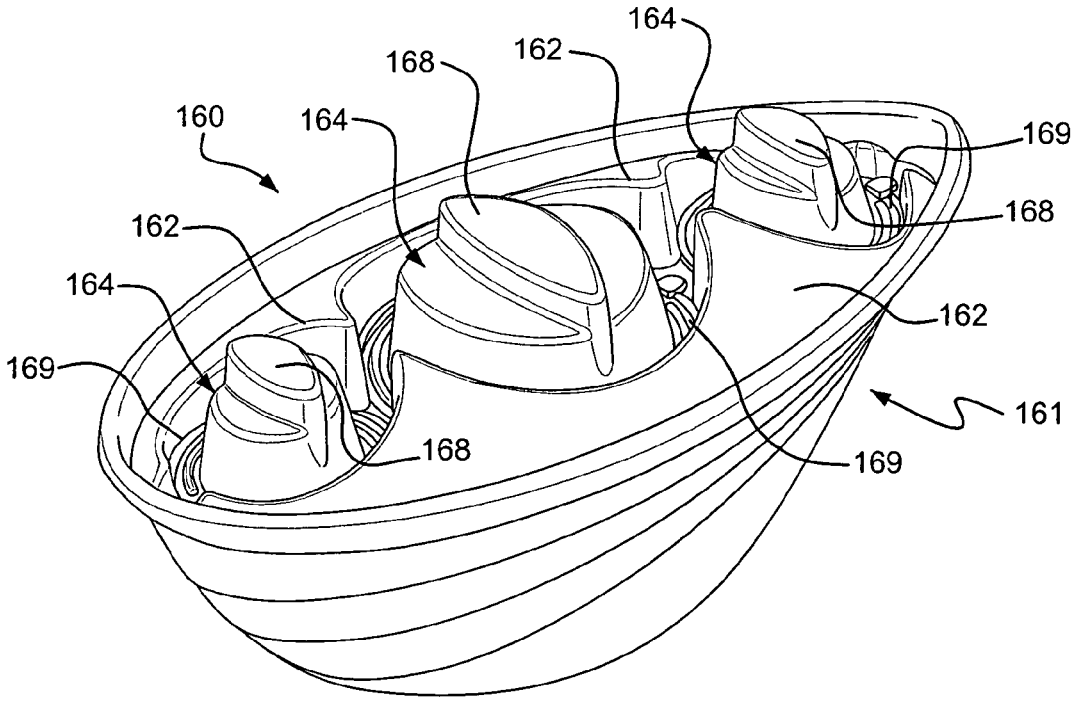
FIG. 14 is a top perspective view of a food container according to the eighth alternative embodiment of the invention.
Figure 15:
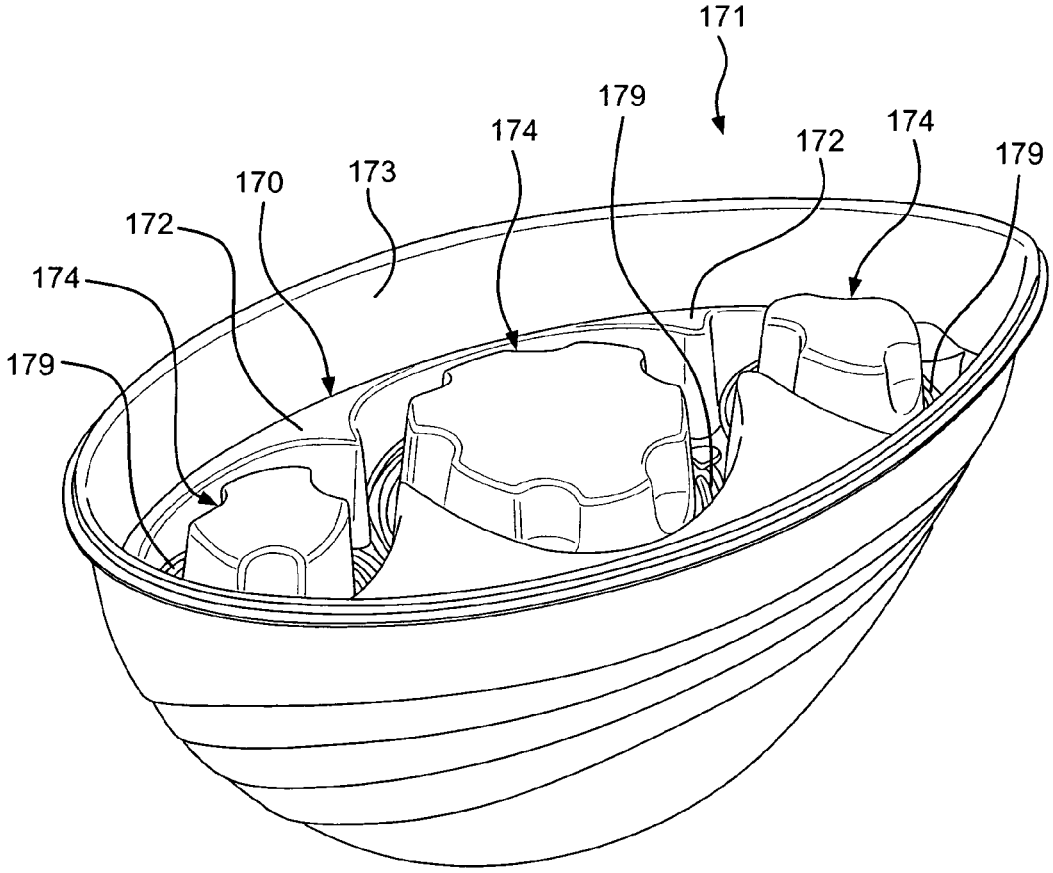
FIG. 15 is a top perspective view of a food container according to the ninth embodiment of the invention.

Further embodiments of the kit are illustrated in FIGS. 13-15. In the embodiment illustrated in FIG. 13, the tray 150 of container 151 is integrated with a top wall 152, eliminating a separate cover. With this configuration, the cups 154 are recessed from the top 156 of the tray 150 and submerged by the top 152 of the tray 150 such that the tops of the cups 154 are lower than the top walls 152. The function of the cups 154 is the same as that described in the embodiment illustrated in FIGS. 1-7, but the structure of the tray 150 is modified.

The container seen in FIG. 14 presents a tray 160 of container 161 integrated with a top wall 162. With this configuration, the cups 164 are partially recessed from the top 162 of the tray 160 such that the bottoms of the cups 164 are lower than the top walls 162, but the tops of the cups 164 are slightly above the top walls 162. The function of the cups 164 is the same as that described in the previous embodiments, but the structure of the tray and cover is modified. Also, each cup 164 includes a knob 168 protruding from the upper end 163 of the cup 164. A user grasps the knob 168 and rotates to rotate the cup 164 around the ring 169.

The container seen in FIG. 15 illustrates a tray 170 of container 171 integrated with a top wall 172. With this configuration, the tray 170 is partially recessed from the side wall 173 of the container 171. Similar to the embodiment illustrated in FIG. 13, the cups 174 are recessed from the top walls 172 of the tray 170. The function of the cups 174 is the same as that described in the previous embodiments, but the structure of the tray 170 is modified. A plastic film, or similar material, can be disposed across the side walls 173 of the container 171 to cover the tray 170 and contents of the container 171 until consumption.

While a particular embodiment has been chosen to illustrate the invention, it will be understood by those skilled in the art that various changes and modifications can be made therein without departing from the scope of the invention as defined in the appended claims.

What is claimed is:

1. A method of dispensing a condiment into a food container, the method including the following steps:
- fitting a rim of at least one cup between a lip of a ring and a guide on the ring covering a cutting mechanism;
- fitting the ring on a tray lip surrounding an opening of a tray to prevent rotation of the ring relative to the tray;
- gripping an end of the cup received in the ring;
- rotating the cup in a plane in the ring;
- perforating a lining covering an open end of the cup adjacent a top of the food container with the cutting mechanism; and
- dispensing contents from the cup into the food container.

2. The method of claim 1, further including the step of:
- removing the tray from the food container.

3. The method of claim 1, further including the step of:
- combining the contents dispensed from the cup with the remaining contents of the food container.

4. The method of claim 1, wherein rotating the cup in the plane of the ring rotates the lining against a blade that perforated the lining, thereby further opening the lining.

5. The method of claim 1, wherein the step of dispensing the contents from the cup into the food container comprises squeezing the cup.

6. A method of dispensing a substance into a container, the method including the following steps:
- fitting a rim of at least one cup between a substantially planar lip of a ring and a guide on the ring covering a cutting mechanism;
- fitting the ring on a substantially planar tray lip surrounding an opening of a tray to prevent rotation of the ring relative to the tray;
- gripping an end of the cup received on the substantially planar lip of the ring;
- rotating the cup on the lip of the ring;
- perforating a lining covering an open end of the cup adjacent a top of the container with the cutting mechanism; and
- dispensing contents from the cup into the container.

7. The method of claim 6, wherein rotating the cup on the lip of the ring rotates the lining against a blade that perforated the lining, thereby further opening the lining.

8. The method of claim 6, wherein the step of dispensing the contents from the cup into the food container comprises squeezing the cup.

9. A method of dispensing a substance into a container, the method including the following steps:
- fitting a rim of at least one cup between a lip of a ring and a guide on the ring covering a cutting mechanism;
- fitting the ring on a tray lip surrounding an opening of a tray to prevent rotation of the ring relative to the tray;
- gripping an end of the cup received in the ring;
- rotating the cup in the ring without advancing the cup in a direction substantially perpendicular to the lip;

perforating a lining covering an open end of the cup adjacent a top of the container with the cutting mechanism; and dispensing contents from the cup into the container.

* * * * *